US012253081B2

(12) United States Patent
Song et al.

(10) Patent No.: US 12,253,081 B2
(45) Date of Patent: Mar. 18, 2025

(54) SCROLL COMPRESSOR WITH ADJUSTING MECHANISM FOR REDUCING SWING OF ECCENTRIC BUSH

(71) Applicant: Hanon Systems, Daejeon (KR)

(72) Inventors: Se Young Song, Daejeon (KR); Ok Hyun Kim, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/576,186

(22) PCT Filed: Feb. 14, 2023

(86) PCT No.: PCT/KR2023/002171
§ 371 (c)(1),
(2) Date: Jan. 3, 2024

(87) PCT Pub. No.: WO2023/182659
PCT Pub. Date: Sep. 28, 2023

(65) Prior Publication Data

US 2025/0003406 A1 Jan. 2, 2025

(30) Foreign Application Priority Data

Mar. 22, 2022 (KR) ..... 10-2022-0035463

(51) Int. Cl.
*F04C 18/02* (2006.01)
*F04C 29/00* (2006.01)
*F04C 29/06* (2006.01)

(52) U.S. Cl.
CPC ..... *F04C 18/0215* (2013.01); *F04C 29/0057* (2013.01); *F04C 29/06* (2013.01);
(Continued)

(58) Field of Classification Search
CPC .. F04C 18/0215; F04C 29/0057; F04C 29/06; F04C 2240/60; F04C 2240/605; F04C 2240/807
See application file for complete search history.

(56) References Cited

U.S. PATENT DOCUMENTS 4,580,956 A * 4/1986 Takahashi ..... F01C 1/0215 418/57
5,460,494 A * 10/1995 Lee ..... F04C 29/0057 418/57
11,225,966 B2 * 1/2022 Moon ..... F04C 29/0057

FOREIGN PATENT DOCUMENTS

CN 111140497 A * 5/2020
JP H08319981 A 12/1996
(Continued)

*Primary Examiner* — Mary A Davis
(74) *Attorney, Agent, or Firm* — James D. Miller; Shumaker, Loop & Kendrick, LLP

(57) ABSTRACT

A scroll compressor including a shaft configured to be rotated by a drive source; an eccentric bush having a recess portion into which the shaft is inserted, an eccentric portion eccentric to the shaft, and a balance weight for balancing a rotation; an orbiting scroll configured to be orbited by the eccentric portion; and a fixed scroll configured to be engaged with the orbiting scroll, and a rotational clearance is formed between an outer peripheral surface of the shaft and an inner peripheral surface of the recess portion, and the eccentric bush is formed to be capable of performing a swing motion relative to the shaft in a range of the rotational clearance based on a drive pin configured to connect the shaft and the eccentric bush, and an adjusting mechanism configured to reduce the swing motion of the eccentric bush is disposed between the shaft and the eccentric bush.

15 Claims, 8 Drawing Sheets

(52) U.S. Cl.
CPC .... *F04C 2240/60* (2013.01); *F04C 2240/605* (2013.01); *F04C 2240/807* (2013.01)

(56) References Cited

FOREIGN PATENT DOCUMENTS

| | | | | |
|---|---|---|---|---|
| JP | 2016102484 | A | | 6/2016 |
| KR | 20090077291 | A | | 7/2009 |
| KR | 20140109826 | A | | 9/2014 |
| KR | 20200112247 | A | | 10/2020 |
| KR | 20210011229 | A | * | 2/2021 |

* cited by examiner

SCROLL COMPRESSOR WITH ADJUSTING MECHANISM FOR REDUCING SWING OF ECCENTRIC BUSH

CROSS REFERENCE TO RELATED PATENT APPLICATIONS

This is a U.S. national phase patent application of PCT/KR2023/002171 filed Feb. 14, 2023 which claims the benefit of and priority to Korean Patent Application No. 10-2022-0035463, filed on Mar. 22, 2022, the entire contents of each of which are incorporated herein by reference.

TECHNICAL FIELD

The present disclosure relates to a scroll compressor, more particularly, a scroll compressor capable of compressing a refrigerant by means of a fixed scroll and an orbiting scroll.

BACKGROUND ART

In general, an air conditioning (A/C) device is installed in a vehicle to cool or heat the interior of the vehicle. The air conditioning device includes a compressor which is a component of a cooling system, and the compressor compresses a low-temperature and low-pressure gaseous refrigerant introduced from an evaporator to make a high-temperature and high-pressure gaseous refrigerant and delivers the refrigerant to a condenser.

The compressors are classified into a reciprocating compressor which compresses a refrigerant using a reciprocating motion of a piston, and a rotary compressor which compresses a refrigerant using a rotational motion. Depending on methods of transmitting driving power, the reciprocating compressors are classified into a crank compressor which transmits power to a plurality of pistons using a crank, and a swash plate compressor which transmits power to a shaft on which a swash plate is installed. The rotary compressors are classified into a vane rotary compressor which uses a rotating rotary shape and vanes, and a scroll compressor which uses an orbiting scroll and a fixed scroll.

The scroll compressor has an advantage in that the scroll compressor may obtain a relatively higher compression ratio than other compressors, smoothly perform processes of introducing, compressing, and discharging the refrigerant, and thus obtain stable torque. Therefore, the scroll compressor is widely used to compress the refrigerant in an air conditioning device or the like.

FIG. 1 is a cross-sectional view that illustrates a conventional scroll compressor, FIG. 2 is an exploded perspective view that illustrates a shaft and an eccentric bush of a scroll compressor of FIG. 1, FIG. 3 is a front view that illustrates a disposition relationship of a shaft and an eccentric bush when a scroll compressor of FIG. 1 is normally operated, and FIG. 4 is a front view that illustrates a state in which an eccentric bush of FIG. 3 is swung with respect to a shaft by a rotational clearance. Here, the shaft is illustrated in a dotted line in FIGS. 3 and 4.

Referring to FIGS. 1 and 2, a conventional scroll compressor includes a drive source 20, a shaft 30 configured to be rotated by the drive source 20, a recess portion 41, into which the shaft 30 is inserted, and an eccentric bush 40 having an eccentric portion 42 eccentric to the shaft 30, an orbiting scroll 50 configured to perform a swing motion by the eccentric portion 42, and a fixed scroll 60 configured to form a compression chamber together with the orbiting scroll 50.

Here, the eccentric bush 40 is formed to have a rotational clearance between an inner peripheral surface 41*a* of the recess portion 41 and an outer peripheral surface 31 of the shaft 30, in order to prevent damage to the orbiting scroll 50 and the fixed scroll 60 due to liquid refrigerant compression during, for example, an initial operation. That is, the eccentric bush 40 is formed for transmitting a swing motion of the shaft 30 in a buffered manner according to the designed rotational clearance, rather than transmitting the swing motion immediately to the eccentric bush 40, so that the scroll compressor in a normal operation state is rotated together with the shaft 30, in a state in which the recess portion 41 and the shaft 30 are concentric with each other as illustrated in FIG. 3. However, for example, during the initial operation, as illustrated in FIG. 4, the scroll compressor is swung with respect to the shaft 30 and is rotated together with the shaft 30, in a state in which a rotational radius of the eccentric portion 42 is adjusted.

However, there was a problem in the conventional scroll compressor in that an impact sound was generated between the shaft 30 and the eccentric bush 40, and noise and vibration of the compressor deteriorated. That is, for example, when a compression reactive force increases, a rotational velocity of the shaft 30 is decreased, or a rotation of the shaft 30 is stopped, there was a problem in that the inner peripheral surface 41*a* of the recess portion 41 hit the outer peripheral surface of the shaft 30 due to the rotational clearance, thereby the impact sound was generated, as illustrated in FIG. 4.

SUMMARY

Therefore, an object of the present disclosure is to provide a scroll compressor capable of preventing the impact sound between the shaft and the eccentric bush.

One embodiment is a scroll compressor, including: a shaft configured to be rotated by a drive source; an eccentric bush having a recess portion into which the shaft is inserted, an eccentric portion eccentric to the shaft, and a balance weight for balancing a rotation; an orbiting scroll configured to be orbited by the eccentric portion; and a fixed scroll configured to be engaged with the orbiting scroll, and a rotational clearance may be formed between an outer peripheral surface of the shaft and an inner peripheral surface of the recess portion, and the eccentric bush may be formed to be capable of performing a swing motion relative to the shaft in a range of the rotational clearance based on a drive pin configured to connect the shaft and the eccentric bush, and an adjusting mechanism configured to reduce the swing motion of the eccentric bush may be disposed between the shaft and the eccentric bush.

The adjusting mechanism may be formed to apply a force in a counter-clockwise direction to the eccentric bush when the eccentric bush swings in a clockwise direction, and apply a force in a clockwise direction when the eccentric bush swings in a counter-clockwise direction.

The adjusting mechanism may include a fastening portion configured to be fastened to the drive pin, and an eccentric bush pressing portion configured to press the eccentric bush.

The adjusting mechanism may further include a shaft supporting portion extending from the fastening portion and is supported by the shaft.

A distal end face of the shaft may include a first distal end face positioned at a center side and a second distal end face positioned at an outside of the first distal end face, and the first distal end face is formed to protrude toward the eccentric bush than the second distal end face to form a stepped surface between the first distal end face and the second distal end face, and the adjusting mechanism may be disposed between the second distal end face and a base surface of the recess portion, the shaft supporting portion may be supported on the stepped surface, and the eccentric bush pressing portion may be formed to press an inner peripheral surface of the recess portion.

At least a part of an inner peripheral surface of the shaft supporting portion may be formed to correspond to an outer peripheral surface of the stepped surface.

At least a part of an outer peripheral surface of the eccentric bush pressing portion may be formed to correspond to the inner peripheral surface of the recess portion.

An imaginary circle contacting the inner peripheral surface of the shaft supporting portion and an imaginary circle formed by an outer peripheral surface of the eccentric bush pressing portion may be formed to be concentric with each other.

The shaft supporting portion may include a first shaft supporting portion extending along the stepped surface from the fastening portion, and a second shaft supporting portion extending along the stepped surface toward an opposite side of the first shaft supporting portion from the fastening portion.

A distal end of the first shaft supporting portion and a distal end of the second shaft supporting portion may be spaced apart from each other.

A sum of a length of the first shaft supporting portion and a length of the distal end of the second shaft supporting portion may be equal to or greater than a half of a periphery of the stepped surface.

The eccentric bush pressing portion may include a first eccentric bush pressing portion extending along the inner peripheral surface of the recess portion from the fastening portion, and a second eccentric bush pressing portion extending along the inner peripheral surface of the recess portion toward an opposite side of the first eccentric bush pressing portion from the fastening portion.

A distal end of the first eccentric bush pressing portion and a distal end of the second eccentric bush pressing portion may be spaced apart from each other.

The adjusting mechanism may further include a slit configured to space the shaft supporting portion apart from the eccentric bush pressing portion in a radial direction of the swing motion of the eccentric bush.

An axial thickness of the adjusting mechanism may be formed to be equal to an axial thickness of the stepped surface.

The scroll compressor according to the present disclosure includes: a shaft configured to be rotated by a drive source; an eccentric bush having a recess portion into which the shaft is inserted, an eccentric portion eccentric to the shaft, and a balance weight for balancing a rotation; an orbiting scroll configured to be orbited by the eccentric portion; and a fixed scroll configured to be engaged with the orbiting scroll, and a rotational clearance is formed between an outer peripheral surface of the shaft and an inner peripheral surface of the recess portion, and the eccentric bush is formed to be capable of performing a swing motion relative to the shaft in a range of the rotational clearance based on a drive pin configured to connect the shaft and the eccentric bush, and an adjusting mechanism configured to reduce the swing motion of the eccentric bush is disposed between the shaft and the eccentric bush. Therefore, it is possible to prevent an impact sound generated between the shaft and the eccentric bush.

DESCRIPTION OF AN EMBODIMENT

Hereinafter, the scroll compressor according to the present disclosure will be described in detail with reference to accompanying drawings.

Figure 1:
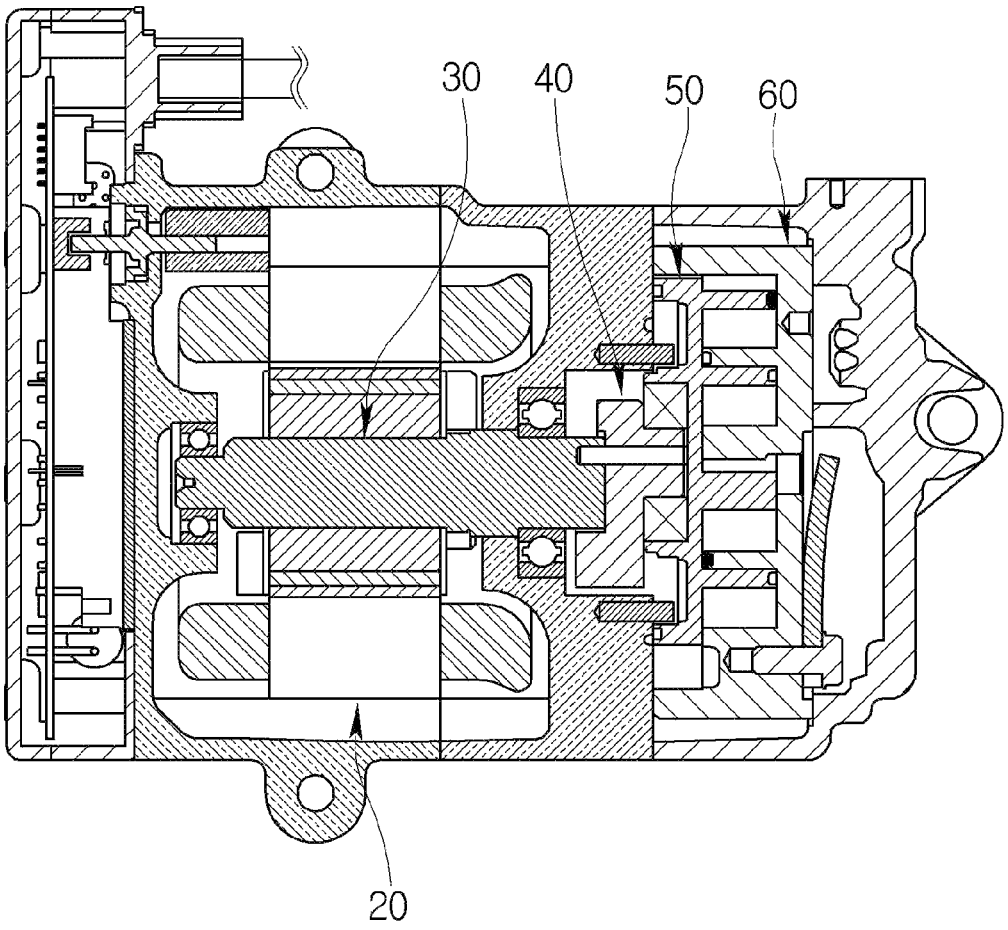
FIG. 1 PRIOR ART
FIG. 1 is a cross-sectional view that illustrates a conventional scroll compressor.
Figure 2:
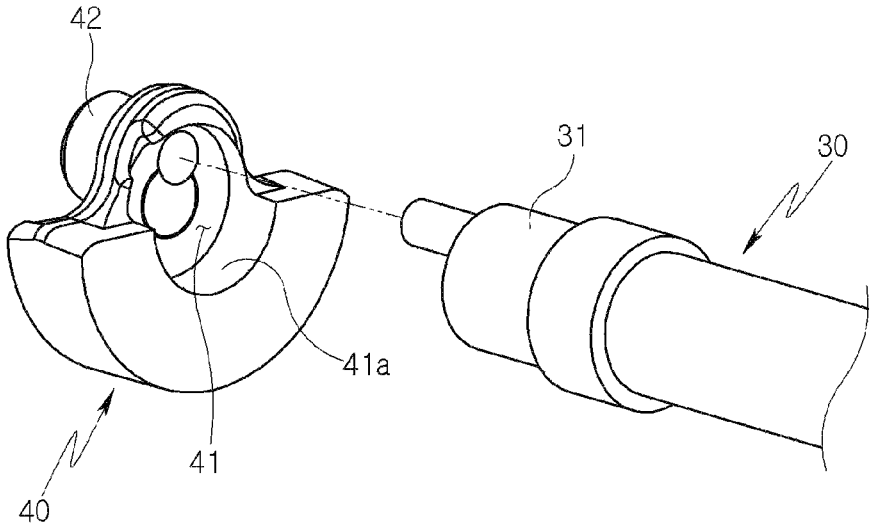
FIG. 2 PRIOR ART
FIG. 2 is an exploded perspective view that illustrates a shaft and an eccentric bush of a scroll compressor of FIG. 1.
Figure 3:
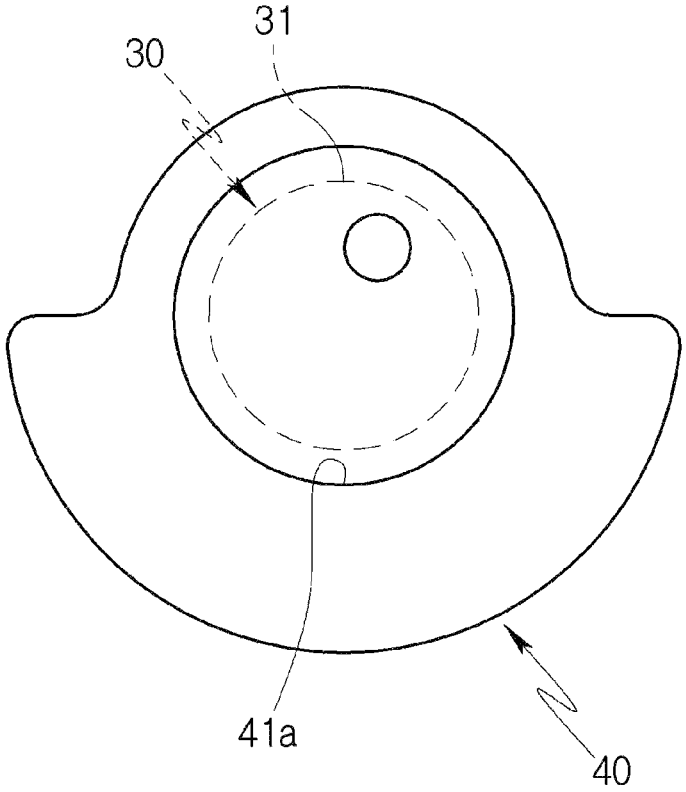
FIG. 3 PRIOR ART
FIG. 3 is a front view that illustrates a disposition relationship of a shaft and an eccentric bush when a scroll compressor of FIG. 1 is normally operated.
Figure 4:
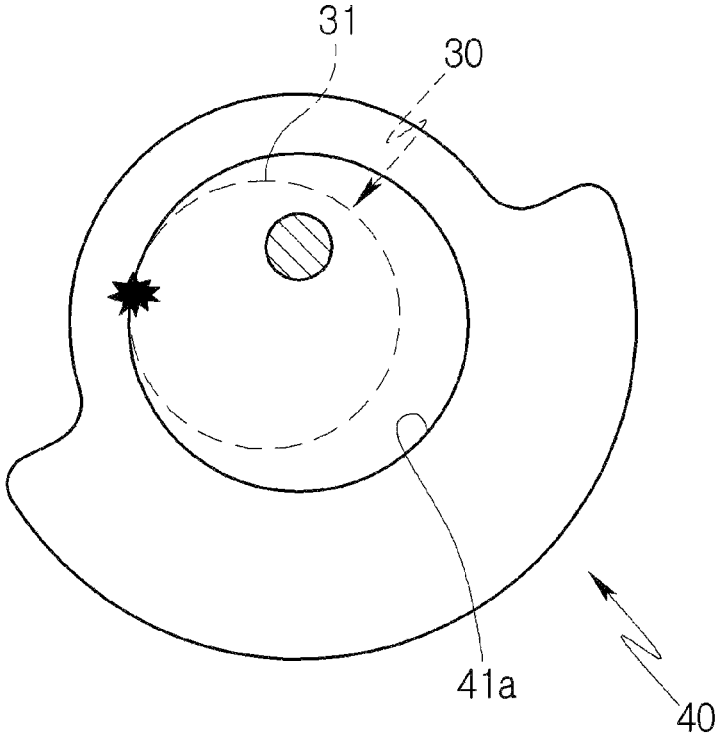
FIG. 4 PRIOR ART
FIG. 4 is a front view that illustrates a state in which an eccentric bush of FIG. 3 is swung with respect to a shaft by a rotational clearance.
Figure 5:
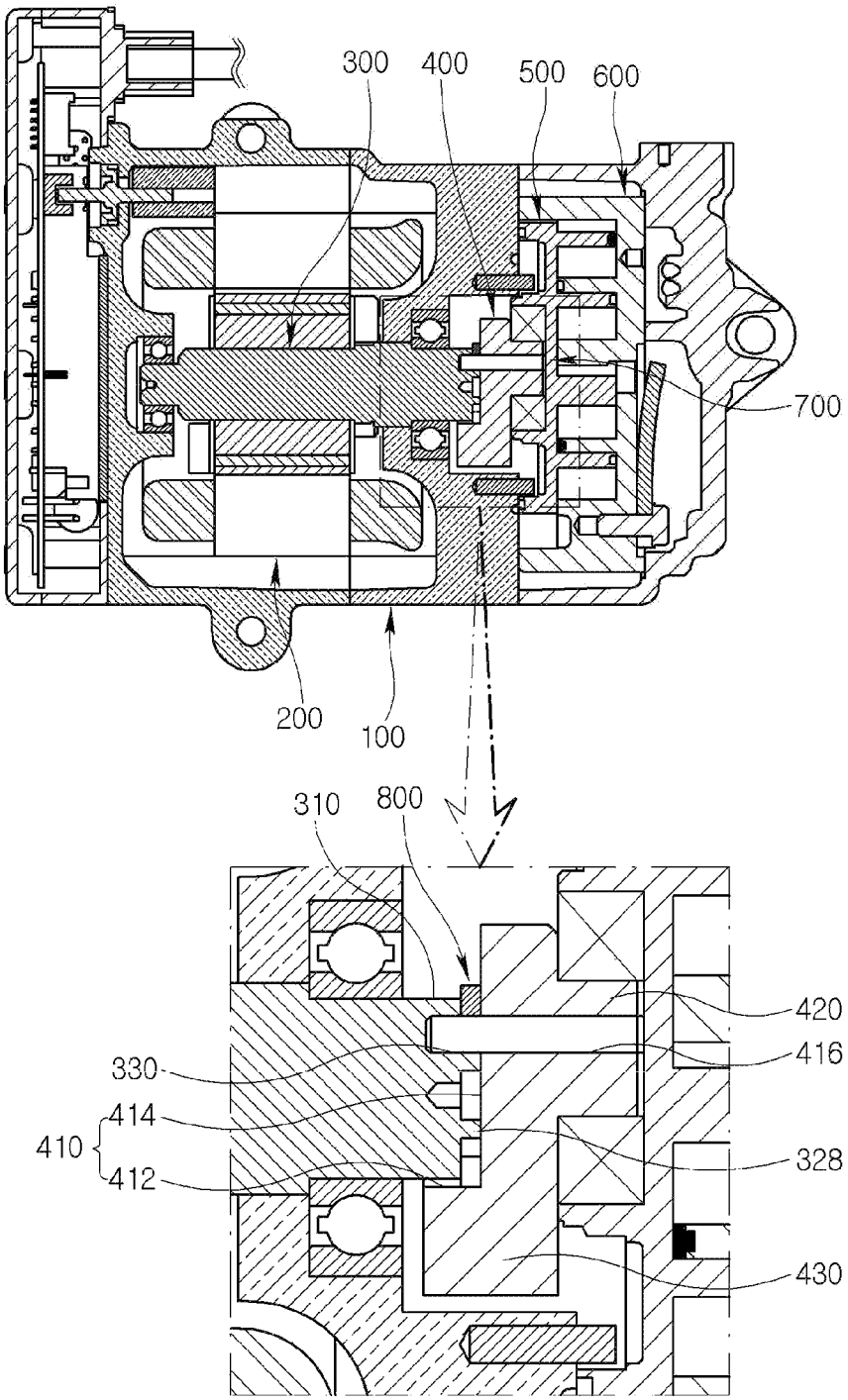
FIG. 5 is a cross-sectional view that illustrates a scroll compressor according to an embodiment of the present disclosure.
Figure 6:
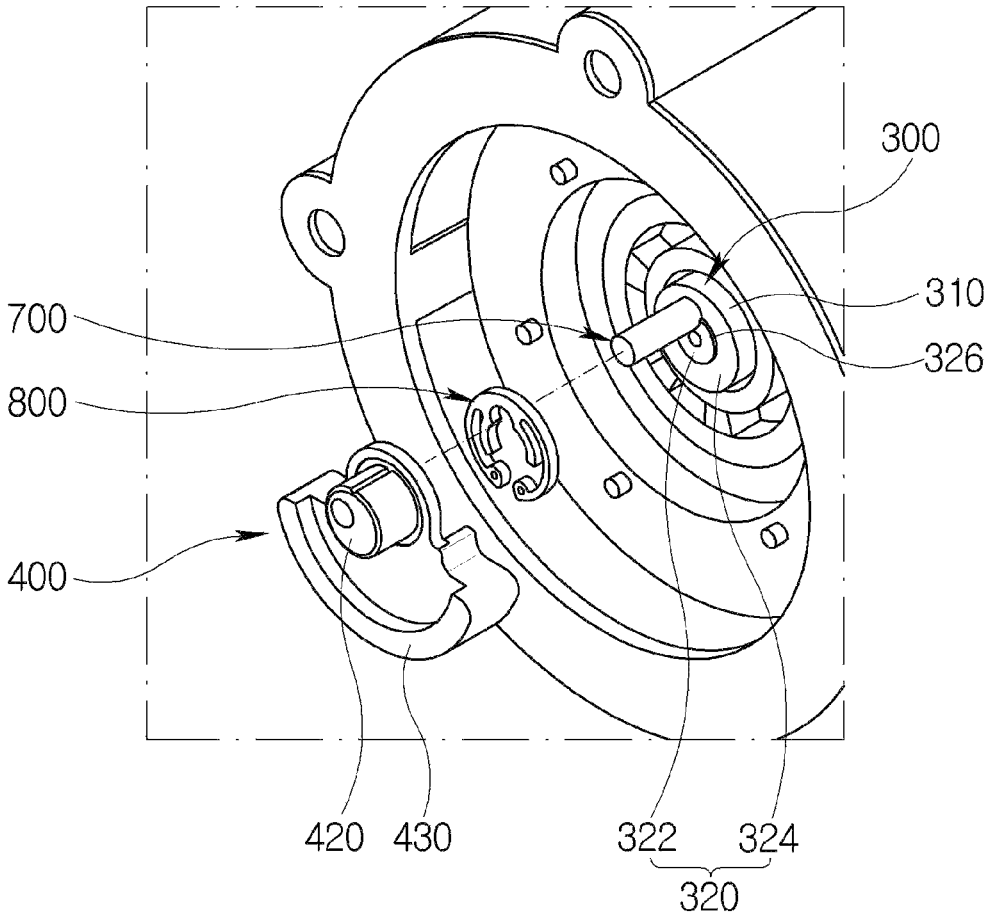
FIG. 6 is an exploded perspective view that illustrates a shaft, an eccentric bush, and an adjusting mechanism of a scroll compressor of FIG. 5.
Figure 7:
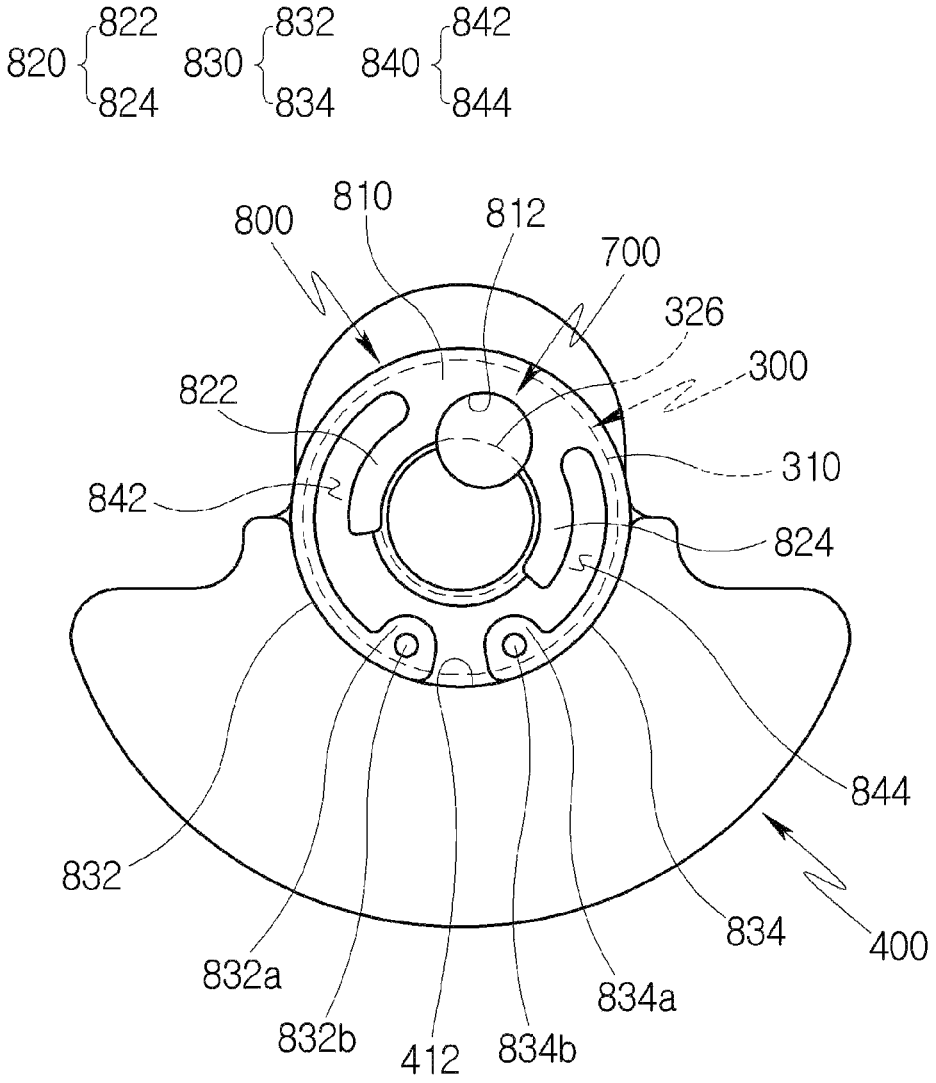
FIG. 7 is a front view that illustrates a disposition relationship of a shaft, an eccentric bush, and an adjusting mechanism when a scroll compressor of FIG. 5 is normally operated.
Figure 8:
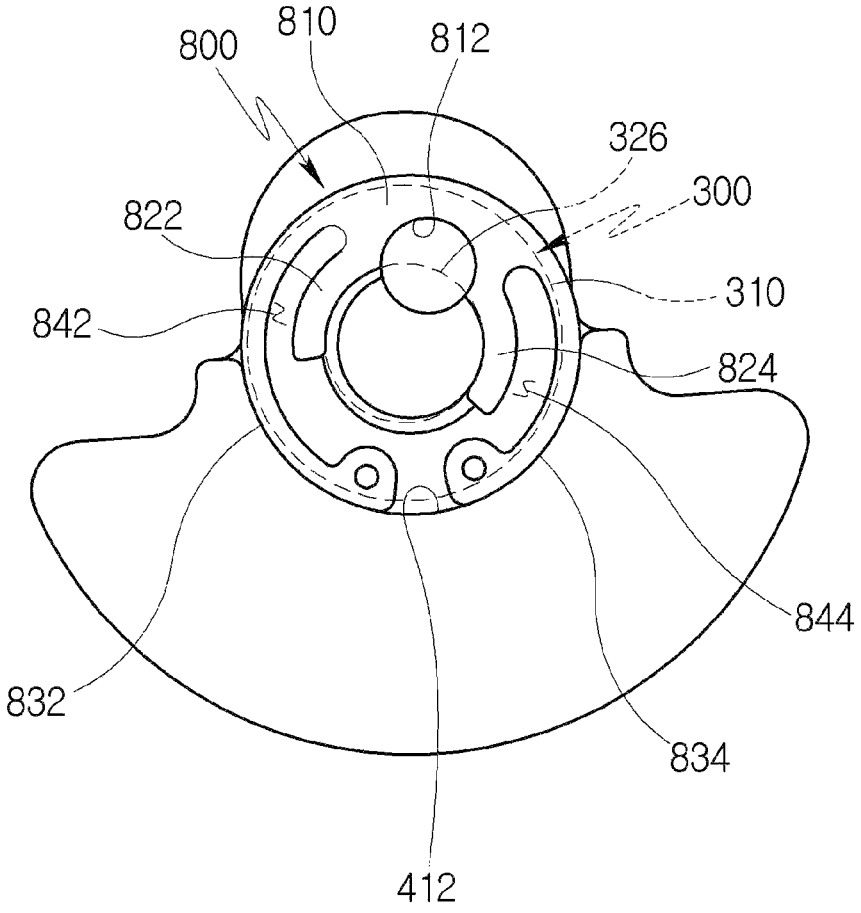
FIG. 8 is a front view that illustrates a state in which an eccentric bush of FIG. 7 is swung with respect to a shaft by a rotational clearance.

FIG. 5 is a cross-sectional view that illustrates the scroll compressor according to the embodiment of the present disclosure, FIG. 6 is an exploded perspective view that illustrates a shaft, an eccentric bush, and an adjusting mechanism of the scroll compressor of FIG. 5, FIG. 7 is a front view that illustrates a disposition relationship of a shaft, an eccentric bush, and an adjusting mechanism when the scroll compressor of FIG. 5 is normally operated, and FIG. 8 is a front view that illustrates a state in which an eccentric bush of FIG. 7 is swung with respect to a shaft by a rotational clearance. Here, the shaft is illustrated in a dotted line in FIGS. 7 and 8.

Referring to FIGS. 5 to 8, the scroll compressor according to the embodiment of the present disclosure may include: a casing 100, a drive source 200 provided in the casing and configured to generate a rotational force, a shaft configured to be rotated by the drive source 200, an eccentric bush 400 configured to convert a rotational motion of the shaft 300 into an eccentric rotational motion, an orbiting scroll 500 configured to be orbited by the eccentric bush 400, and a fixed scroll 600 configured to be engaged with the orbiting scroll 500 and form a compression chamber together with the orbiting scroll 500.

Here, the drive source 200 may be formed as a motor having a stator and a rotor, or a disc hub assembly operatively connected to a vehicle engine.

In addition, the shaft 300 may be formed in a cylindrical shape extending in one direction, and the shaft 300 may have one end coupled to the eccentric bush 400, and the other end coupled to the drive source 200.

In addition, the eccentric bush 400 may include a recess portion 410 into which the shaft 300 is inserted, an eccentric portion 420 protruding toward an opposite side of the shaft 300 with respect to the recess portion 410, and a balance weight 430 disposed on an opposite side of the eccentric portion 420 with respect to the recess portion 410 so as to balance an overall rotation of the eccentric bush 400, and the recess portion 410, the eccentric portion 420, and the balance weight 430 may be integrally formed.

Meanwhile, the shaft 300 and the eccentric bush 400 may be formed to allow presence of a rotational clearance between an inner peripheral surface 412 of the recess portion 410 and an outer peripheral surface 310 of the shaft 300, so as to prevent damage to the scroll due to liquid refrigerant compression during, for example, the initial operation.

That is, the shaft 300 and the eccentric bush 400 may be slidably coupled to the shaft 300 based on a position in which the eccentric bush 400 is eccentric from a rotational axis of the shaft 300.

Particularly, the shaft 300 is formed in a cylindrical shape, and in a distal end face 320 of the shaft 300, a first insertion groove 330, into which one end of a drive pin 700, configured to connect the shaft 300 and the eccentric bush 400, is inserted may be formed.

The first insertion groove 330 may be formed at a position, at which a center of the first insertion groove 330 is spaced apart from the rotational axis of the shaft 300 in a radial direction of the shaft 300, so that a center axis of the drive pin 700 can be arranged at a position, which is eccentric to the rotational axis of the shaft 300.

Further, the drive pin 700 is formed in a cylindrical shape which extends in a direction parallel to an axial direction of the shaft 300, and the first insertion groove 330 may be cylindrically recessed while having an inner diameter corresponding to an outer diameter of the drive pin 700 so as to correspond to the drive pin 700.

The recess portion 410 of the eccentric bush 400 may be cylindrically recessed so as to correspond to the shaft 300.

In addition, the recess portion 410 may be formed such that an inner diameter of the recess portion 410 is formed to be greater than an outer diameter of the shaft 300, so that the eccentric bush 400 can swing with respect to the shaft 300, based on the drive pin 700. That is, a gap between the inner peripheral surface 412 of the recess portion 410 and the outer peripheral surface 310 of the shaft 300 may be greater than zero.

Further, a second insertion groove 416, into which the other end of the drive pin 700 is inserted, may be formed in a base surface 414 of the recess portion 410, opposing the distal end face 320 of the shaft 300.

The second insertion groove 416 may be formed at a position, at which a center of the second insertion groove 416 is spaced apart from the center axis of the recess portion 410 in a radial direction of the recess portion 410, so that the center axis of the drive pin 700 can be disposed at a position eccentric to the center axis of the recess portion 410. Here, it is preferable that the second insertion groove 416 is formed at a position, opposing to the first insertion groove 330, when the recess portion 410 is disposed at a position, concentric to the shaft 300, so that the eccentric bush 400 can swing in one direction and a direction opposite to the one direction with respect to the shaft 300.

In addition, the second insertion groove 416 may be cylindrically recessed while having an inner diameter equal to the outer diameter of the drive pin 700 so as to correspond to the drive pin 700.

Meanwhile, the scroll compressor according to the present embodiment may further include an adjusting mechanism 800 disposed between the shaft 300 and the recess portion 410 so as to prevent generation of an impact sound which occurs when the eccentric bush 400 hits the shaft 300.

The adjusting mechanism 800 may be formed to reduce a swing motion of the eccentric bush 400 by applying a force to the eccentric bush 400 in a direction opposite to a direction of the swing motion of the eccentric bush 400.

Particularly, the distal end face 320 of the shaft 300, located at a center side, includes a second distal end face 324, located at a radially outside of the first distal end face 322, and the first distal end face 322 protrudes toward the base surface 414 of the recess portion 410 than does the second distal end face 324, thereby a stepped surface 326 may be formed between the first distal end face 322 and the second distal end face 324. That is, the shaft 300 may include a protrusion 328 which forms the first end face 322 and the stepped surface 326.

The adjusting mechanism 800 may include a fastening portion 810 fastened to the drive pin 700, a shaft supporting portion 820 extending in a circumferential direction from the fastening portion 810 and supported by the stepped surface 326, and an eccentric bush pressing portion 830 extending in a circumferential direction from the fastening portion 810 and pressing the inner peripheral surface 412 of the recess portion 410, and may be disposed between the second distal end face 324 and the base surface 414 of the recess portion 410.

The fastening portion 810 may include a fastening hole 812, into which the drive pin 700 is inserted.

Here, the first insertion groove 330 is formed over the second distal end face 324 as well as the first distal end face 322, the fastening hole 812 is formed to be opened at one side, and it is preferable that a center angle of the fastening hole 812 is formed to be greater than 180 degrees so that the drive pin 700 is prevented from leaving the fastening groove 812 through the opening of the fastening hole 812.

The shaft supporting portion 820 may include a first shaft supporting portion 824 extending along the stepped surface 326 from the fastening portion 810, and a second shaft supporting portion 824 extending along the stepped surface 326 in a direction opposite to the first shaft supporting portion 822 from the fastening portion 810.

Here, a distal end of the first shaft supporting portion 822 and a distal end of the second shaft supporting portion 824 are spaced apart from each other to prevent interference with a first convex portion 832*a* and a second convex portion 834*a*, and it is preferable that a center angle of the shaft supporting portion 820 is formed to be greater than 180 degrees so that the protrusion 328 of the shaft 300 is restricted from leaving the shaft supporting portion 820 through an opening between the distal end of the first shaft supporting portion 822 and the second shaft supporting portion 824. That is, a sum of a length of the first shaft supporting portion 822 and a length of the second shaft supporting portion 824 may be equal to, or greater than a half of a periphery of the stepped surface 326.

In addition, at least a part of the inner peripheral surface of the shaft supporting portion 820 is formed to correspond to the outer peripheral surface of the stepped surface 326, and an overall inner diameter of the shaft supporting portion 820 may be equal to an outer diameter of the stepped surface 326 so that the stepped surface 326 of the shaft 300 can be slidably supported on the inner peripheral surface of the shaft supporting portion 820.

The eccentric bush pressing portion 830 may include a first eccentric bush pressing portion 832 extending along the inner peripheral surface 412 of the recess portion 410 in a direction of the first shaft supporting portion 822 from the fastening portion 810, and a second eccentric bush pressing portion 834 extending along the inner peripheral surface 412 of the recess portion 410 toward an opposite side of the first shaft supporting portion 822 from the fastening portion 810.

Here, a distal end of the first eccentric bush pressing portion 832 and a distal end of the second eccentric bush pressing portion 834 are spaced apart from each other, and at the distal end of the first eccentric bush pressing portion 832, a first gripping hole 832*b* and a first convex portion 832*a* formed to be convex radially inward to form the first gripping hole 832*b* are formed, and at the distal end of the second eccentric bush pressing portion 834, a second gripping hole 834*b* and a second convex portion 834*a* radially inward to form the second gripping hole 834*b* are formed, thereby increasing the convenience in an assembly between the adjusting mechanism 800 and the eccentric bush 400. That is, when an operator grips the first gripping hole 832*b* and the second gripping hole 834*b* and puts the distal end of the first eccentric bush pressing portion 832 and the distal end of the second eccentric bush pressing portion 834 together, an overall outer diameter of the eccentric bush pressing portion 830 is reduced, thereby the adjusting mechanism 800 may be easily inserted into the recess portion 410.

In addition, at least a part of an outer peripheral surface of the eccentric bush pressing portion 830 is formed to correspond to an inner peripheral surface of the recess portion 410, and an overall outer diameter of the eccentric bush pressing portion 830 may be equal to the inner diameter of the recess portion 410, so that a pre-pressure present between the eccentric bush pressing portion 830 and the inner peripheral surface 412 of the recess portion 410 is formed to be small and thus, the inner peripheral surface 412 of the recess portion 410 can be slidably supported on the eccentric bush pressing portion 830. That is, an overall diameter of the eccentric bush pressing portion 830 may be slightly greater than the inner diameter of the recess portion 410 in a state before an assembly, and may be equal to the inner diameter of the recess portion 410 in a state after the assembly.

In addition, an imaginary circle formed by the outer peripheral surface of the eccentric bush pressing portion 830 may be formed to be concentric with an imaginary circle adjoining the inner peripheral surface of the shaft supporting portion 820, so that the eccentric bush 400 can return to a centering position after being swung with respect to the shaft 300.

Meanwhile, the adjusting mechanism 800 may further include a slit 840 configured to space the shaft supporting portion 820 apart in a radial direction of a swing motion of the eccentric bush 400 from the eccentric bush pressing portion 830, so that deformation of the adjusting mechanism 800 due to a swing of the eccentric bush 400 can be absorbed. That is, the adjusting mechanism 800 may further include a first slit 842 formed between the first shaft supporting portion 822 and the first eccentric bush pressing portion 832, and a second slit 844 formed between the second shaft supporting portion 824 and the second eccentric bush pressing portion 834.

Meanwhile, as described above, the adjusting mechanism 800 is disposed between the second distal end face 324 and the base surface 414 of the recess portion 410, and if the adjusting mechanism protrudes toward the base surface 414 of the recess portion 410 than does the protrusion 328, the base surface 414 of the recess portion 410 may be damaged by an edge of the shaft supporting portion 820, and if the protrusion 328 protrudes toward the base surface 414 of the recess portion 410 than does the adjusting mechanism 800, the base surface 414 of the recess portion 410 may be damaged by an edge of the protrusion 328. Considering the above, an axial thickness of the adjusting mechanism 800 is preferably formed to be equal to a protrusion amount (an axial width of the stepped surface 326) of the protrusion 328 so as to prevent damage to the base surface 414 of the recess portion 410.

Meanwhile, the adjusting mechanism 800 may be preferably formed of a metal material, instead of a resin material so as to improve reliability.

Hereinafter, the operation and effect of the scroll compressor according to the present embodiment will be described.

That is, when electric power is applied to the drive source 200, a series of processes may be repeated in which the shaft 300 is rotated together with the rotor 220, the orbiting scroll 500 is operatively connected to the shaft 300 through the eccentric bush 400 for orbiting, and a refrigerant is sucked into the compression chamber by the orbiting of the orbiting scroll 500, compressed in the compression chamber, and discharged from the compression chamber. Here, in the scroll compressor according to the present embodiment, the rotational clearance is formed between the shaft 300 and the eccentric bush 400. Thus, when the scroll compressor is normally operated, the eccentric bush 400 is rotated together with the shaft 300 in the state in which the recess portion 410 and the shaft 300 are concentric with each other, as illustrated in FIG. 7. However, for example, when a liquid refrigerant is present as in initial operation, the eccentric bush 400 may be rotated together with the shaft 300 in the state in which the eccentric bush 400 is swung with respect to the shaft 300 so that the radius of rotation of the eccentric bush 400 is adjusted, as illustrated in FIG. 8. That is, the rotational motion of the shaft 300 is not be immediately transmitted to the eccentric bush 400 but is transmitted thereto in a buffered manner according to the designed rotational clearance. Therefore, it is possible to prevent damage to the scrolls due to liquid refrigerant compression.

In addition, as the adjusting mechanism 800 configured to reduce a swing motion of the eccentric bush 400 is formed between the shaft 300 and the recess portion 410, the impact sound between the shaft and the eccentric bush 400 is prevented and the eccentric bush 400 may return to the centering position after being swung.

Particularly, as illustrated in FIG. 8, when the eccentric bush 400 is swung in a counter-clockwise direction, a gap between the first shaft supporting portion 822 and the first eccentric bush pressing portion 832 is reduced, and the deformation of the adjusting mechanism 800 is absorbed by the first slit 842, and in this case, the elastic force by which the eccentric bush 400 to be swung in a clockwise direction may be applied to the eccentric bush 400 by the first eccentric bush pressing portion 832.

To the contrary, although not illustrated, when the eccentric bush 400 is swung in a clockwise direction, a gap between the second shaft supporting portion 824 and the second eccentric bush pressing portion 834 is reduced, and the deformation of the adjusting mechanism 800 is absorbed by the second slit 844, and in this case, the elastic force by which the eccentric bush 400 to be swung may be applied to the eccentric bush 400 by the second eccentric bush pressing portion 834.

Therefore, as a sudden swing of the eccentric bush 400 may be restricted, and a conflict between the outer peripheral surface 310 of the shaft 300 and the inner peripheral surface 412 of the recess portion 410 may be restricted, the impact sound generated between the outer peripheral surface 310 of the shaft 300 and the inner peripheral surface 412 of the recess portion 410 may be reduced. In addition, even if the eccentric bush 400 is swung temporarily, the eccentric bush 400 may return to the centering position by the elastic force.

Meanwhile, in the present embodiment, the adjusting mechanism 800 includes the shaft supporting portion 820 as well as the eccentric bush pressing portion 830, however the shaft supporting portion 820 may be omitted.

The invention claimed is:

1. A scroll compressor, comprising:

a shaft configured to be rotated by a drive source;

an eccentric bush having a recess portion into which the shaft is inserted, an eccentric portion eccentric to the shaft, and a balance weight for balancing a rotation;

an orbiting scroll configured to be orbited by the eccentric portion; and a fixed scroll configured to be engaged with the orbiting scroll, wherein a rotational clearance is formed between an outer peripheral surface of the shaft and an inner peripheral surface of the recess portion, and the eccentric bush is formed to be capable of performing a swing motion relative to the shaft in a range of the rotational clearance based on a drive pin configured to connect the shaft and the eccentric bush, and wherein an adjusting mechanism configured to reduce the swing motion of the eccentric bush is disposed between the shaft and the eccentric bush.

2. The scroll compressor of claim 1, wherein the adjusting mechanism is formed to apply a force in a counter-clockwise direction to the eccentric bush when the eccentric bush swings in a clockwise direction, and apply a force in a clockwise direction when the eccentric bush swings in a counter-clockwise direction.

3. The scroll compressor of claim 2, wherein the adjusting mechanism further comprises a fastening portion configured to be fastened to the drive pin, and an eccentric bush pressing portion configured to press the eccentric bush.

4. The scroll compressor of claim 3, wherein the adjusting mechanism further comprises a shaft supporting portion extending from the fastening portion and is supported by the shaft.

5. The scroll compressor of claim 4, wherein a distal end face of the shaft further comprises a first distal end face positioned at a center side and a second distal end face positioned at an outside of the first distal end face, and the first distal end face is formed to protrude toward the eccentric bush than the second distal end face to form a stepped surface between the first distal end face and the second distal end face, and wherein the adjusting mechanism is disposed between the second distal end face and a base surface of the recess portion, the shaft supporting portion is supported on the stepped surface, and the eccentric bush pressing portion is formed to press the inner peripheral surface of the recess portion.

6. The scroll compressor of claim 5, wherein at least a part of an inner peripheral surface of the shaft supporting portion is formed to correspond to an outer peripheral surface of the stepped surface.

7. The scroll compressor of claim 5, wherein at least a part of an outer peripheral surface of the eccentric bush pressing portion is formed to correspond to the inner peripheral surface of the recess portion.

8. The scroll compressor of claim 5, wherein an imaginary circle contacting an inner peripheral surface of the shaft supporting portion and an imaginary circle formed by an outer peripheral surface of the eccentric bush pressing portion are formed to be concentric with each other.

9. The scroll compressor of claim 5, wherein the shaft supporting portion further comprises a first shaft supporting portion extending along the stepped surface from the fastening portion, and a second shaft supporting portion extending along the stepped surface toward an opposite side of the first shaft supporting portion from the fastening portion.

10. The scroll compressor of claim 9, wherein a distal end of the first shaft supporting portion and a distal end of the second shaft supporting portion are spaced apart from each other.

11. The scroll compressor of claim 10, wherein a sum of a length of the first shaft supporting portion and a length of the second shaft supporting portion is equal to or greater than a half of a periphery of the stepped surface.

12. The scroll compressor of claim 5, wherein the eccentric bush pressing portion further comprises a first eccentric bush pressing portion extending along the inner peripheral surface of the recess portion from the fastening portion, and a second eccentric bush pressing portion extending along the inner peripheral surface of the recess portion toward an opposite side of the first eccentric bush pressing portion from the fastening portion.

13. The scroll compressor of claim 12, wherein a distal end of the first eccentric bush pressing portion and a distal end of the second eccentric bush pressing portion are spaced apart from each other.

14. The scroll compressor of claim 5, wherein the adjusting mechanism further comprises a slit configured to space the shaft supporting portion apart from the eccentric bush pressing portion in a radial direction of the swing motion of the eccentric bush.

15. The scroll compressor of claim 5, wherein an axial thickness of the adjusting mechanism is formed to be equal to an axial thickness of the stepped surface.

* * * * *